United States Patent [19]

Thys

[11] 4,263,757

[45] Apr. 28, 1981

[54] MODULAR ELEMENT FOR PREFABRICATED BUILDINGS

[75] Inventor: Leon Thys, Bridel, Luxembourg

[73] Assignee: Gestion Internationale De Brevets S.A. "G.I.B.", Luxembourg

[21] Appl. No.: 933,504

[22] Filed: Aug. 14, 1978

[30] Foreign Application Priority Data

Aug. 17, 1977 [LU] Luxembourg ..... 77983

[51] Int. Cl.[3] ..... E04H 1/00

[52] U.S. Cl. ..... 52/79.1; 52/236.1; 52/236.3

[58] Field of Search ..... 52/79.1–79.13, 52/234, 236.1, 236.3

[56] References Cited

U.S. PATENT DOCUMENTS

| | | | |
|---|---|---|---|
| 3,488,900 | 1/1970 | Reid | 52/79.7 |
| 3,694,973 | 10/1972 | Unger | 52/79.1 |
| 3,724,143 | 4/1973 | Paukulis | 52/79.7 |
| 3,729,875 | 5/1973 | Felson | 52/79.7 |
| 3,822,569 | 7/1974 | Lautrap-Larsen | 52/79.1 |
| 3,830,026 | 8/1974 | Tylius | 52/79.2 X |
| 3,835,601 | 9/1974 | Kelbish | 52/79.2 |
| 3,894,373 | 7/1975 | Willingham | 52/236.3 |
| 4,048,772 | 9/1977 | Gaul | 52/236.3 |
| 4,065,907 | 1/1978 | Rice | 52/745 |

FOREIGN PATENT DOCUMENTS

| | | | |
|---|---|---|---|
| 782194 | 4/1968 | Canada | 52/79.7 |
| 2239736 | 4/1973 | Fed. Rep. of Germany | 52/79.7 |
| 2310312 | 9/1973 | Fed. Rep. of Germany | 52/79.7 |
| 2305555 | 10/1976 | France | 52/79.7 |

*Primary Examiner*—J. Karl Bell

*Attorney, Agent, or Firm*—Cushman, Darby & Cushman

[57] ABSTRACT

This invention relates to a modular element for prefabricated buildings, and to buildings constructed using said elements. The modular element according to the invention is of L configuration, one leg of which being designed to constitute a wall portion having a height of one storey, and the other leg of which is designed to form a floor portion or a roof portion of the last storey. In the building according to the invention, the several L elements are disposed perpendicular to other L elements when viewed in plan, the ones being connected to the others by toothed bearings.

17 Claims, 27 Drawing Figures

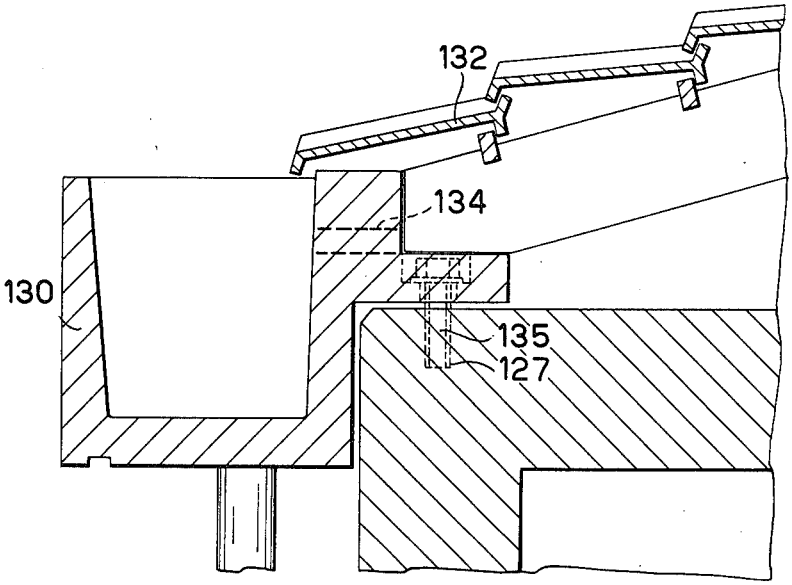
Fig. 8
Fig. 9
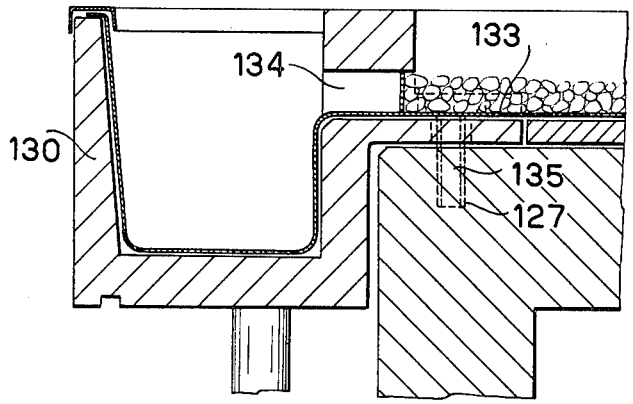
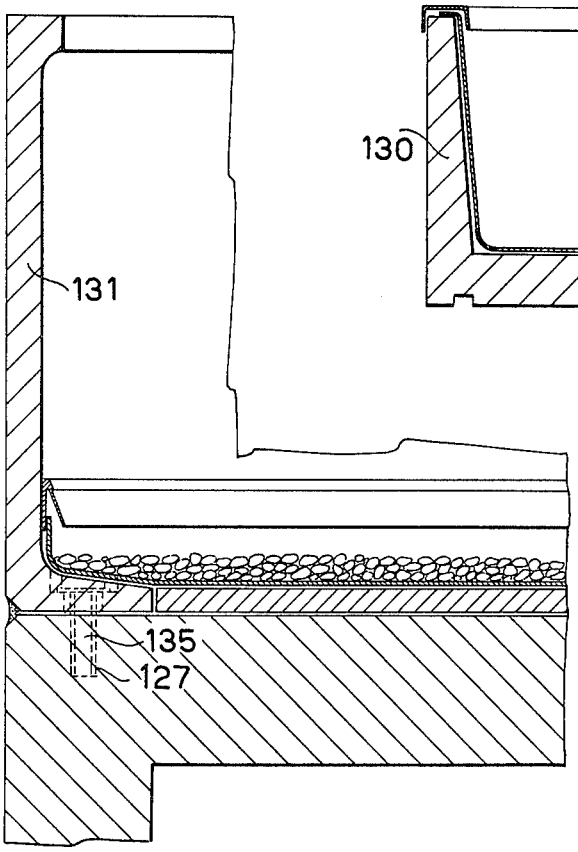
Fig. 10

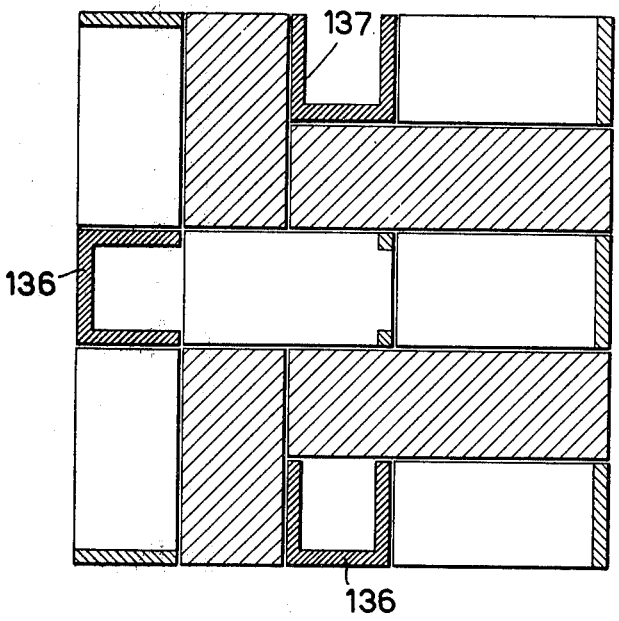
Fig.11
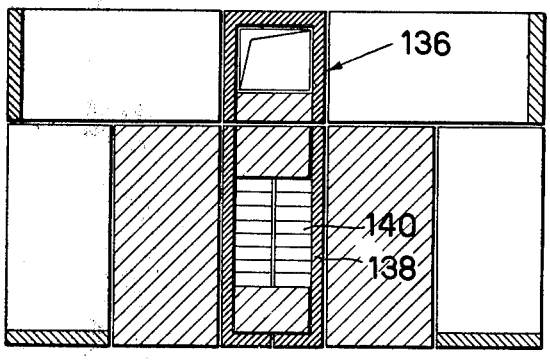
Fig.12
Fig.13
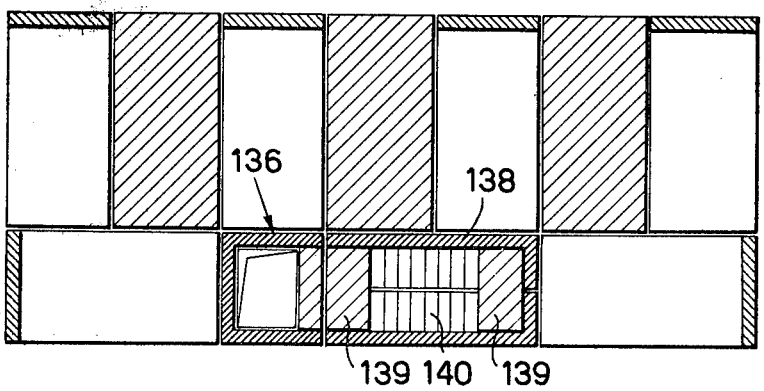

MODULAR ELEMENT FOR PREFABRICATED BUILDINGS

This invention relates to a modular element for prefabricated buildings, and to buildings constructed using said elements.

In the building field, there is at the present time a tendency to construct constructional components as far as possible in the factory, so that the work to be carried out on site is almost exclusively concerned with the assembly and finishing of the building. This tendency is obviously subject to limitations dictated by the overall size and weight of the components in relation to their transportation from the factory to the site.

The assembly of the components on site consists substantially of arranging the components in the required manner, and then joining them together in such a manner that a firm and stable mutual connection is made.

One object of the invention is to further reduce the work to be carried out on site, not only with regard to the formation of the constructional components, but also with regard to their assembly and joining together.

A further object of the invention is to provide a modular element which allows a wide flexibility in the choice of layout of the rooms to be created, this flexibility being not otherwise obtainable by the usual method used in prefabricated buildings.

These and further objects are attained according to the invention by a modular element for single or multistorey prefabricated buildings, suitable for forming load-bearing components of the building to be constructed, said modular element being of L configuration, one leg of which is designed to constitute a wall portion having a height of one storey, and the other leg of which is designed to form a floor portion, or a roof portion of the last storey.

The L element can be advantageously inserted into a precise spacial modular grid.

The sides of the floor portion are step-shaped so as to be able to receive by insertion the corresponding sides of an adjacent modular element, to enable the required building to be stably erected.

The step-shaped sides of adjacent elements comprise a gasket in which metal angle sections are incorporated during casting, these then being welded together.

For this purpose, the region of the joint above these angle sections is made freely accessible, and after the welding operation it is filled with suitable concrete. This region can also be advantageously used as a seat for service pipes or cables.

A further characteristic of the invention is the formation of a structural hinge, i.e. a restraint which ensures resistance to horizontal action, but without transmitting moments. This hinge is located at two points on the edges of the floor slab of the L element, i.e. at the bearing for the overlying L element.

The bearing remains analogous even if the overlying L element is formed from two pillars.

The L element is constructed incorporating two suitable threaded bosses into which a suitable lifting hook is screwed for use during removal from the form, transportation and assembly.

When the element is assembled, the lifting hook is unscrewed and a centering pin screwed in.

A rectangular rubber plate supported by a small thickness metal sheet and provided with a central hole is mounted on the pin, so that the L element mounted on top and guided by the pin discharges its weight and the successive loads on to this dry bearing, which functions as a load distributor so preventing force localisation.

The two pins could obviously be located in the base of the wall portion instead of in the floor portion. Fixing screws can also be screwed into the threaded bosses for gutter and parapet elements and the like.

A further interesting characteristic of the invention is the formation of so-called load-bearing blocks, constituted by a U' element or by two special L elements which are stacked and fixed to other analogous elements in order to form a column which, with other analogous columns, constitutes a bracing structure for the building formed from the required appropriate composition of the modular L elements alternating with slabs.

The elements of U-shape in plan view are braced blocks which can also form the lift shaft, storeroom, kitchen and bathroom. At their top they can either be hollow or closed by a plate. Along their contour they can comprise suitable support teeth for the I elements or slabs.

The elements of L-shape in plan view can be coupled to specular elements to form a composite U element of variable modular dimensions.

These L elements enable braced stair wells to be constructed, with the facility for providing an upper outer tooth for supporting the Ls and slabs, and with suitable internal teeth for supporting stair landings, both at floor level and at intermediate level.

Prefabricated ramps are inserted between the two landings. It is thus possible to form stair blocks with variable ramp width and length dimensions.

It is also possible to insert a lift shaft between two ramps.

A further characteristic of the invention is the formation of a special element, constituted by a cantilever portion which extends the floor region of the L element beyond the line of the vertical wall. This special L enables balconies to be constructed which are continuous over the entire facade of the building, including the corner regions.

This cantilever can also be formed on the corner L, i.e. on the L which already comprises a curtain wall suspended from its horizontal outer edge.

Further characteristics and advantages of the invention will be apparent from the description given hereinafter of one embodiment shown in the accompanying drawings, in which:

FIGS. 8, 9 and 10 are sectional details showing the system for fixing auxiliary elements to the L elements;

FIGS. 11, 12, 13, 14 are plan views showing three examples of the use of the plan-disposed U and L elements;

Figure 1:
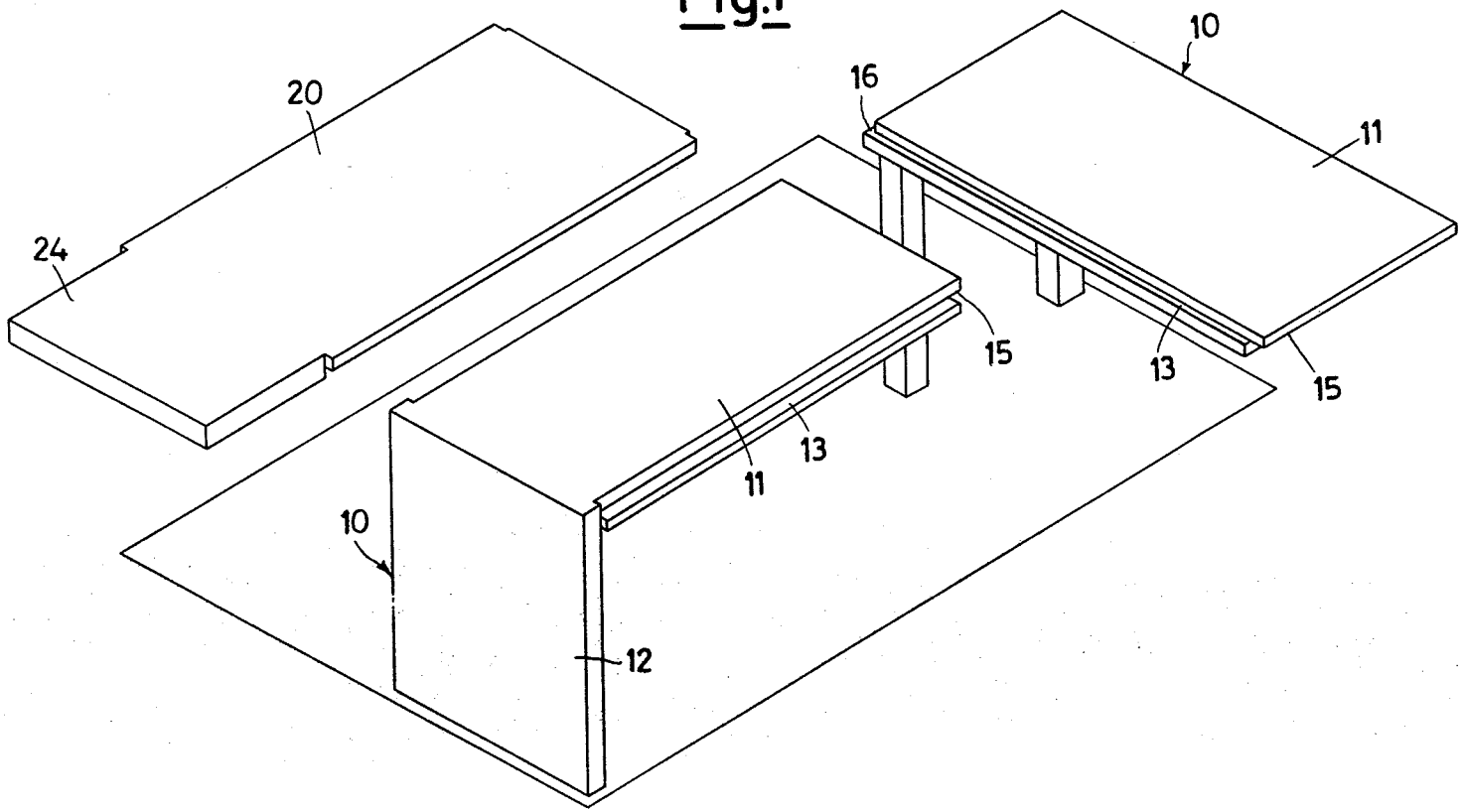
FIG. 1 is an isometric view of modular elements according to the invention.

In FIG. 1, a modular element indicated overall by the reference numeral 10 is configured as a L, the major leg of which is indicated by the reference numeral 11 and the minor leg with reference numeral 12. This latter can also be of portal configuration (L with two pillars) as can be seen on the right hand side of FIG. 1. The minor side can be lightened while keeping the two pillars disposed external to the wall solid. This lightening can be obtained by removing the concrete from the outer or inner face of the wall by means of a suitable caisson, or by inserting into the wall a slab of light material which also acts as a thermal insulant.

The lateral edges of the legs 11 are provided with a lower step 13. The end edge of the major leg 11 is provided with an upper step 15 complementary to the lower step 13 of the lateral edges. Thus the line of convergence of the legs 11 and 12 comprises a fall 16 complementary to the upper step 15.

The edge of the minor leg 12 coincides with the width module of the element.

In the present case, the length of the major leg is double its width.

Figure 2:
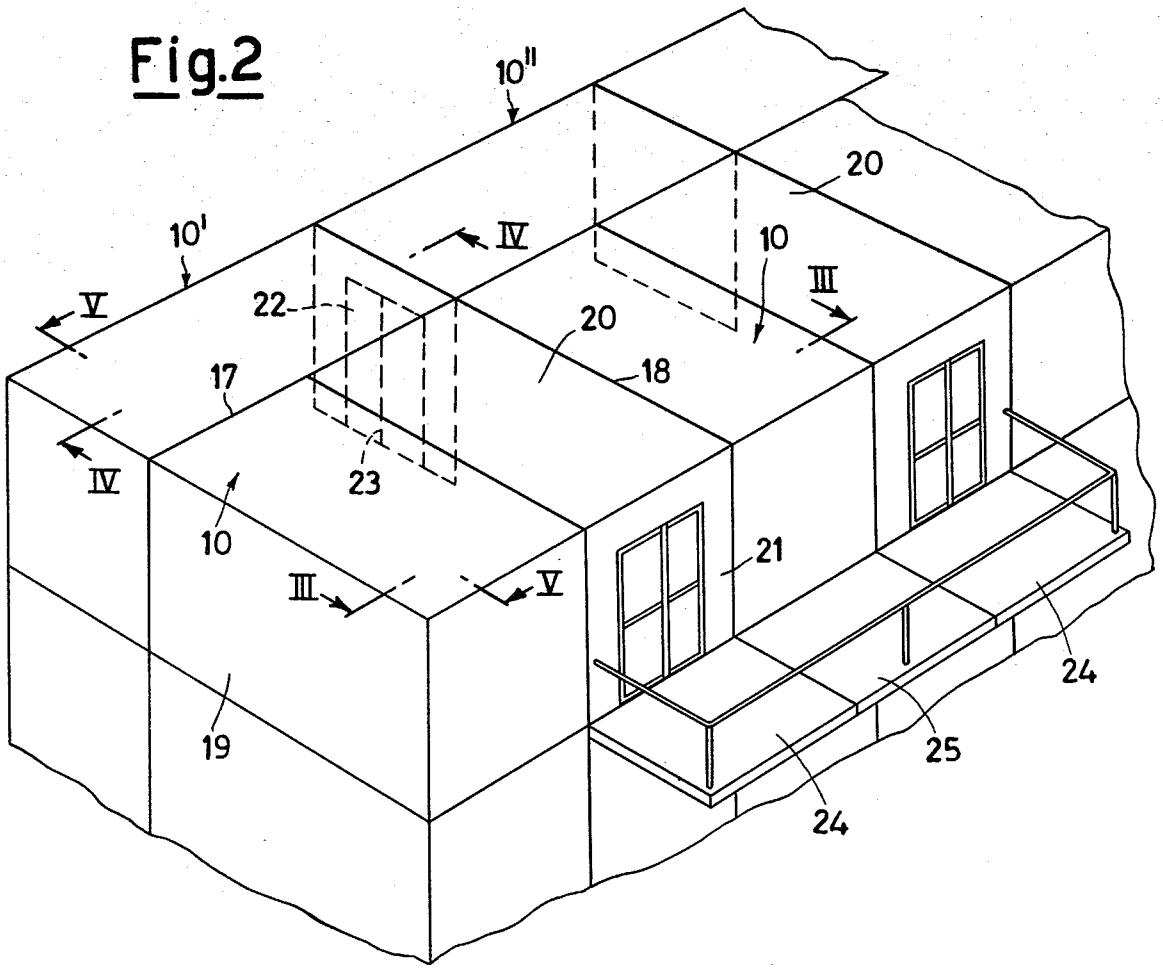
FIG. 2 is an isometric diagrammatic view of a building constructed using modular elements according to the invention.
Figure 3:
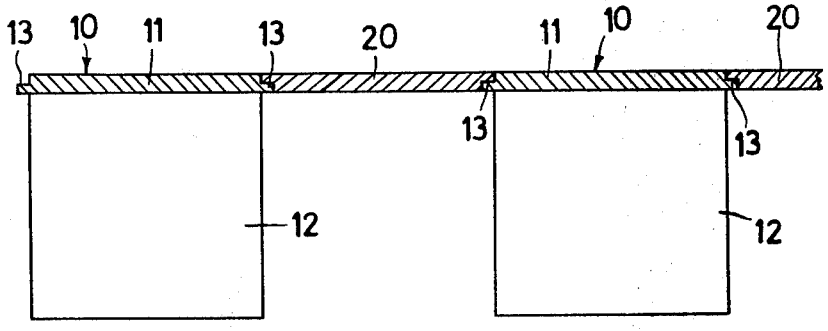
FIG. 3 is a section on the line III—III of FIG. 2.
Figure 4:
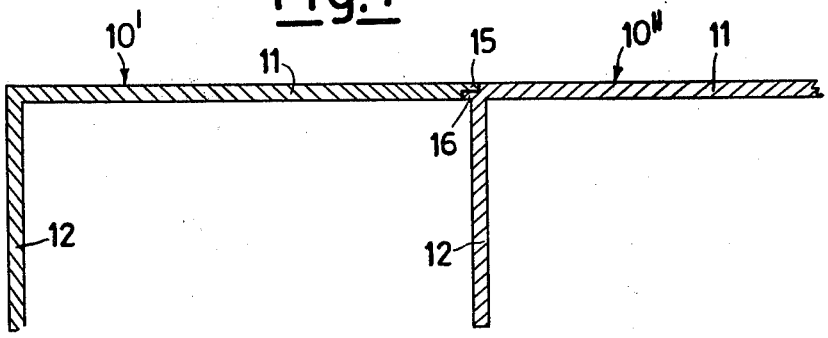
FIG. 4 is a section on the line IV—IV of FIG. 2.
Figure 5:
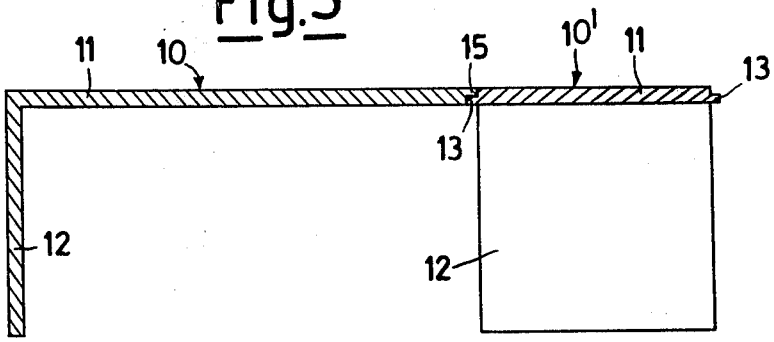
FIG. 5 is a section on the line V—V of FIG. 2.

FIG. 2 shows a building constructed using the elements 10 heretofore described. An element 10, side-by-side with another identical element or with a floor slab of the modular type 20, rests by way of the edge 17 on an L element 10'. The upper end step 15 of the major leg 11 is supported on the lateral step 13 of the major leg 11 of the element 10' by means of a toothed joint. The slab 20 and element 10 are connected together at 18 in a position corresponding with the step 13 by the same type of joint. The minor leg of the L element is connected at its lower free edge to the underlying structure.

In this manner, the major leg 11 of the element 10 forms the floor, and the minor leg 12 the wall of the building.

The free spaces formed between the elements 10, disposed for example at 90° to each other, are suitably closed by means of curtain walls 19, which in the example shown are fixed to the step 13 of the legs 11 and 12 of the element 10, and to the lateral step 13 of the minor leg 12 of the element 10. If the element 10 constitutes a perimetral corner of the building, it can be prefabricated in advance together with the curtain wall 19. The spaces free from perimetral walls are closed by typical prefabricated elements 21, which can be of metal.

Where necessary, the minor leg 12 is configured as a portal 22 to receive, for example, the door post of a door 23.

The slab 20 can extend as a cantilever to form a balcony 24. Two balconies 24 can be connected together by an intermediate slab 25 to provide more extensive balconies.

It should be noted that by choosing differently the position of the modular elements according to the invention, the most varied plan layouts can be obtained, because of which the buildings can be constructed with great flexibility.

The ratio of the length to the width of the floor portion leg can be other than two. It will generally be a whole number, so that the end edges of each leg can be combined exactly with its side edges. These dimensions fall within the modular grid.

The appropriate means for fixing the various elements together are chosen from known types, according to requirements, and are therefore not described.

The constructional components connected to the modular elements according to the invention, such as curtain walls provided with door or window frames, can also be of modular type, and these can therefore be constructed in the factory and easily assembled on site.

Figure 6:
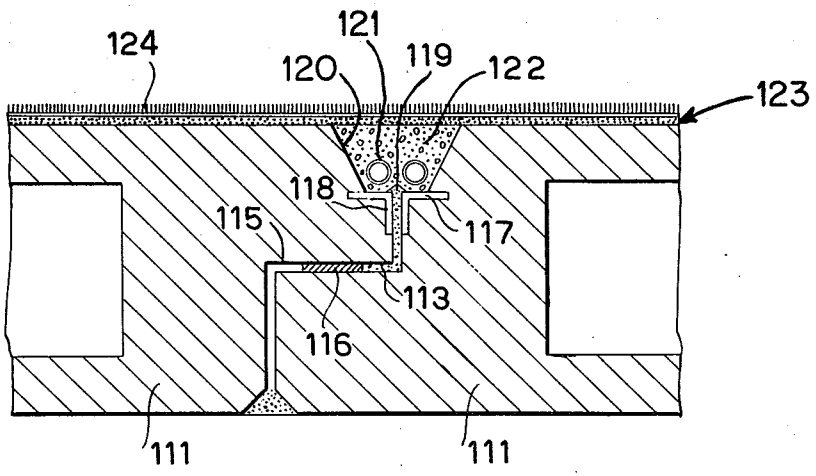
FIG. 6 is a sectional detail showing the joint between L elements or between a L element and a slab.

FIG. 6 of the drawings shows the joint between two floor portions 111 formed by corresponding stepped portions 113 and 115 which are coupled together by way of a suitable jointing material 116.

Characteristically, two metal angle sections 117 and 118 are embedded in the two stepped portions respectively, and are abutted and welded together at 119 in order to form a stable connection between the L elements.

For this purpose, the stepped portions are bevelled above the angle sections at 120 in order to create a free channel access space, where pipes 121 for service purposes can also be housed. This space is then filled with a suitable casting 122. 123 indicates a floor covering for the room, which can advantageously be wall-to-wall carpeting 124.

Figure 7:
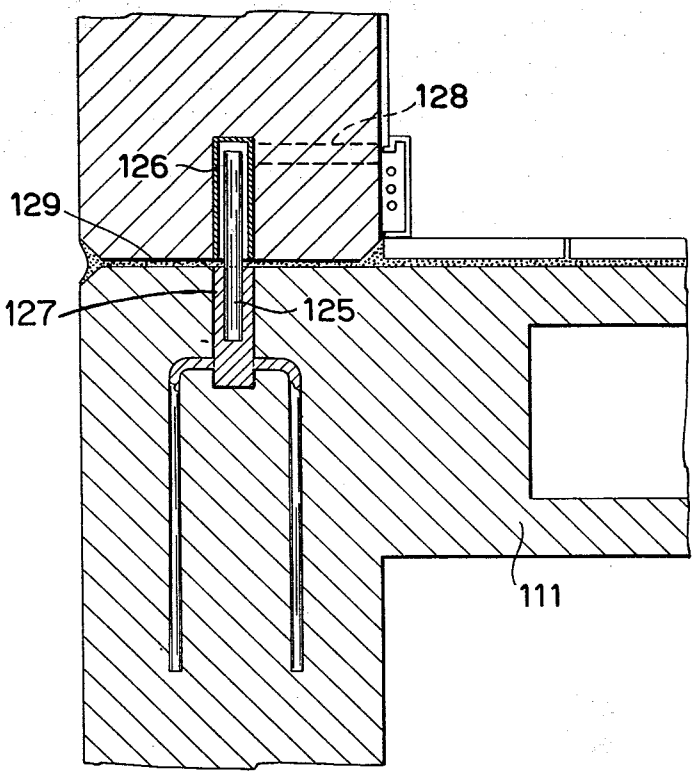
FIG. 7 is a sectional detail showing the system for centering overlying L elements.
Figure 14:
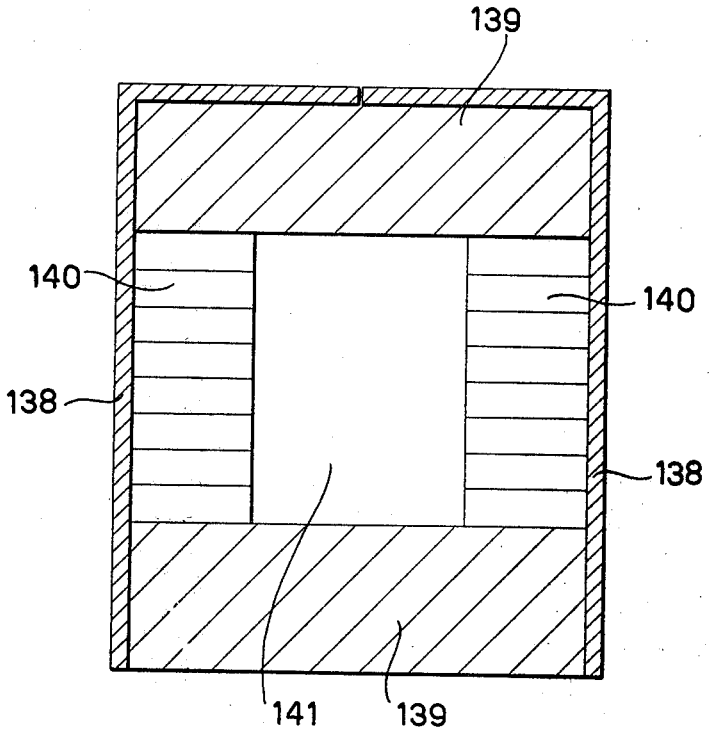

FIG. 7 of the drawings shows a further characteristic of the invention, consisting of providing, at the periphery of those L elements to be laid in overlying disposition, threaded bosses 127 retaining pins 125 which, when inserted into corresponding seats 126, enable the elements to be quickly and accurately centred. In the example illustrated, the pins extend from the floor portion, and the seats are provided in the base of the wall portion, but obviously the arrangement could be the opposite.

A tube 128 is also provided for subsequently injecting a suitable sealing mortar into 126. The rubber plate 129 is retained in position by a central hole into which the pin 125 is inserted.

As clearly shown in FIG. 8, 9 and 10 of the drawings, threaded metal bosses 127 can be embedded into the perimeter of the floor portion 111 to receive a bolt 135 for fixing accessory elements such as a gutter 130 (FIGS. 8 and 9), or a parapet 131 (FIG. 10). The gutter 130 can receive either a pitched roof 132, or a flat roof 133. For this purpose, the gutter 130 is provided with drainage holes 134.

A further characteristic of the invention is shown in FIGS. 11, 12, 13 and 14, and consists of a prefabricated U element 136, 137, and a prefabricated L element 138.

During assembly, several stacks of these elements 136, 137, 138 support the L elements, and when the structure is complete they constitute the bracing system for the building. The U elements are disposed inwardly with an upper slab (136), or outwardly without an upper slab (137).

When the L elements 138 are coupled together, they form a bearing for the landing 139 on which the ramps 140 rest. By increasing the width of the stair bay (FIG. 14), the lift shaft or stair well 141 can be obtained.

Figure 15:
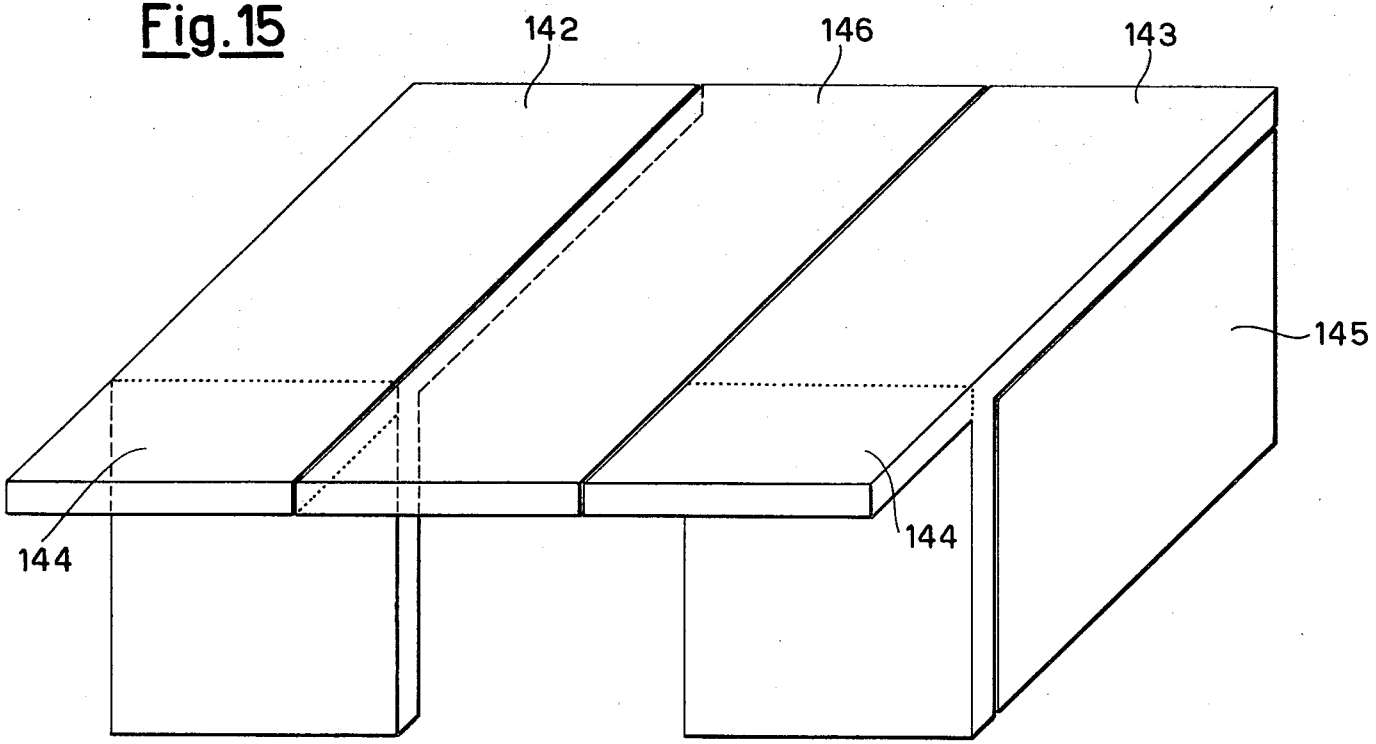
FIG. 15 shows the L element comprising a cantilever portion.

A further characteristic of the invention is illustrated in FIG. 15, which shows a normal L element 142 or a corner L element 143 with a suspended wall 145, both provided with the cantilever portion 144, which is constructed as the elements 142 and 143 are cast.

The plate 146 between the two Ls can also project in the manner of a cantilever.

Figure 16:
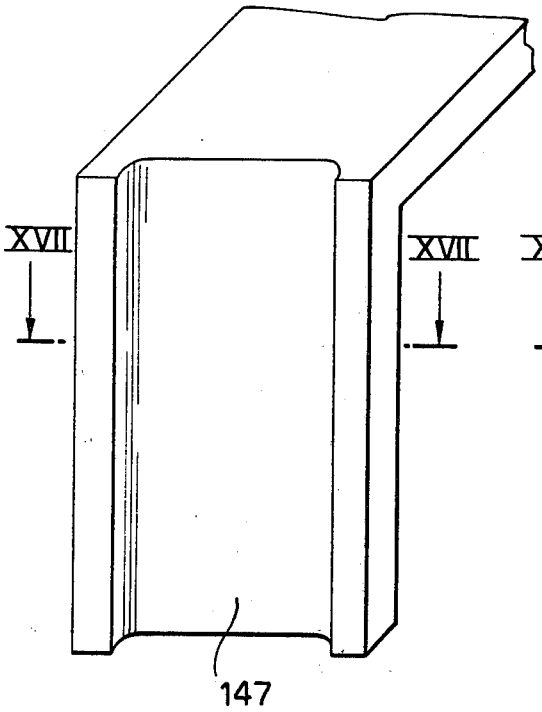
FIG. 16 is a modification of the L.
Figure 18:
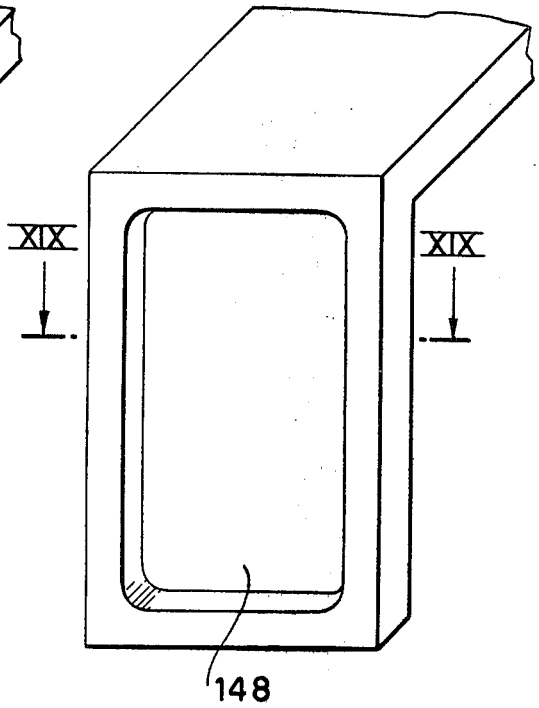
FIG. 18 is a further modification of the L.
Figure 17:
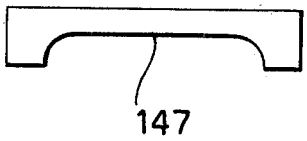
FIG. 17 is a section on the line XVII—XVII of FIG. 16.
Figure 19:
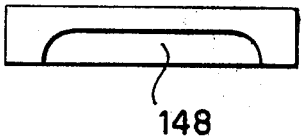
FIG. 19 is a section on the line XIX—XIX of FIG. 18.
Figure 20:
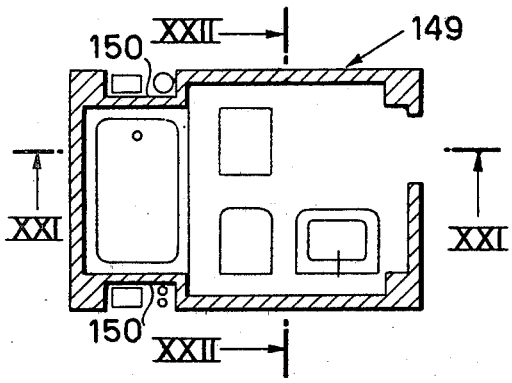
FIG. 20 is a section on the line XX—XX of FIG. 21, showing a bathroom block.
Figure 23:
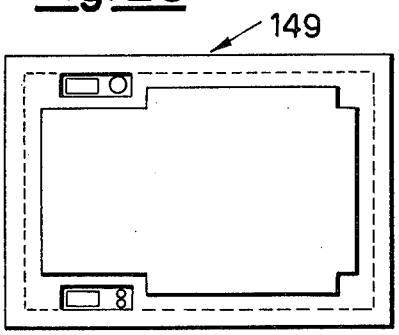
FIG. 23 is a view in the direction of the arrow F of FIG. 21.
Figure 22:
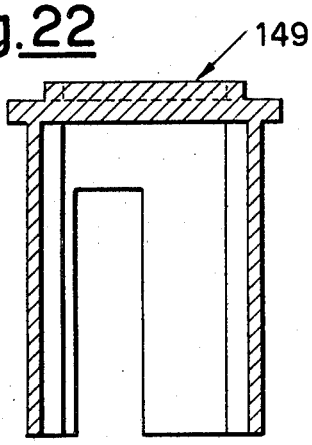
FIG. 22 is a section on the line XXII—XXII of FIG. 20.
Figure 21:
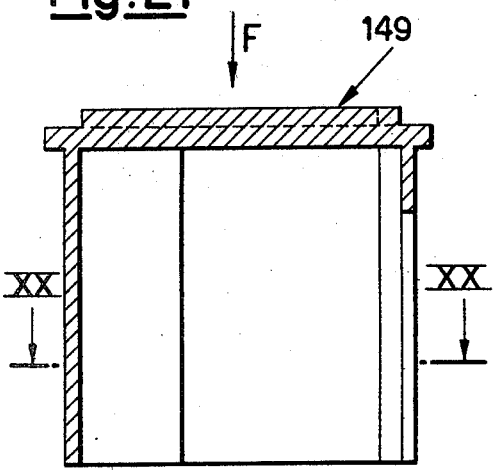
FIG. 21 is a section on the line XXI—XXI of FIG. 20.
Figure 24:
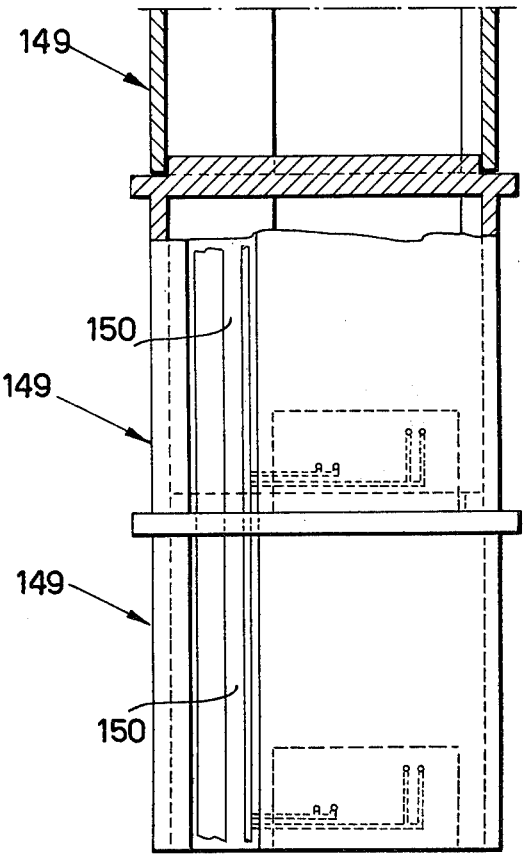
FIG. 24 is a partly sectional elevation showing several stacked bathroom blocks.

FIGS. 16 to 19 show that the vertical wall of the L can be lightened either internally or externally, in order, where the total thickness is not required, to lighten the element without affecting the load-bearing capacity of the two lateral pillars. By way of example, FIGS. 16 and 17 show an L, the outer surface of which is fluted as at 147, so as to create continuous lightening throughout overlying elements, whereas FIGS. 18 and 19 show an L, the outer surface of which comprises a cavity such as 148, to provide lightening surrounded by projecting ribs on the four sides.

FIGS. 20 to 24 show a block 149 comprising a complete bathroom. This block is shaped in such a manner as to define two ducts 150 for the vertical service installations, and is complete with ceiling and walls, so that it can be assembled complete with all services, equipment and internal finishing.

Figure 25:
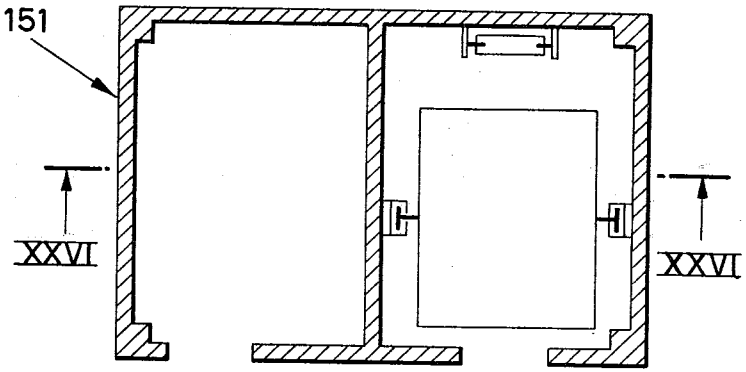
FIG. 25 is a section on the line XXV—XXV of FIG. 26, showing a lift block.
Figure 27:
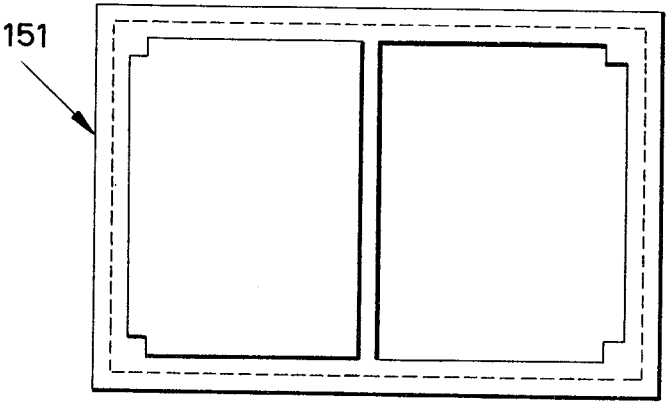
FIG. 27 is a plan view of the lift block.
Figure 26:
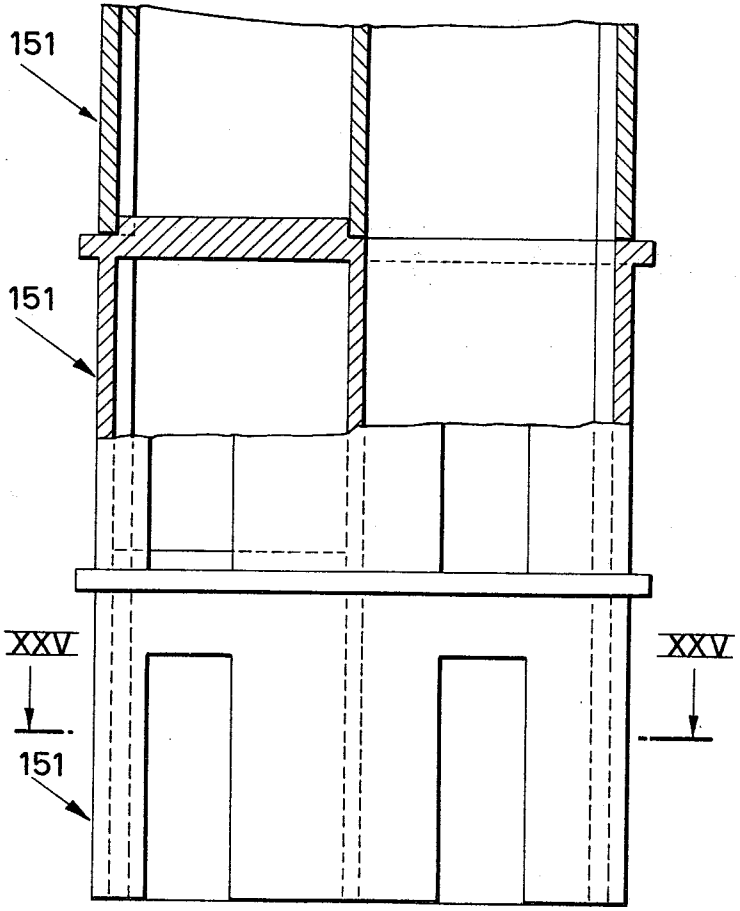
FIG. 26 is a section on the line XXVI—XXVI of FIG. 25 showing several stacked lift blocks.

Likewise, FIGS. 25 to 27 show a block 151 designed to form a lift shaft, which constructed complete with guides for connecting the lift cab and the counterweight.

What I claim is:

1. A building comprising a combination of three pluralities of modular elements, as follows: a plurality of first L-shaped modular elements, each element including a first leg constituting a closed vertical wall portion having a height of one storey and each element including a second leg forming a floor portion or a roof portion of the building; a plurality of second L-shaped modular elements, each element including a first leg constituting a vertical portal wall portion having a height of one storey and each element including a second leg forming a floor portion or roof portion of the building, said portal wall portion comprising at least two parallel spaced-apart posts extending at right angles to said second leg and the space between the outer ends of said posts being unobstructed; and a plurality of third modular elements each of which is a flat slab, said slabs being positioned between spaced-apart L-shaped elements, and the edges of said slabs and the free edges of said second legs of said L-shaped elements have a stepped configuration so as to mate together.

2. A building as claimed in claim 1 wherein at least one of said portal wall portions incorporates prefabricated door or window frames, or inserts.

3. A building as claimed in claim 1 wherein at least one of said portal wall portions is prefabricated with a curtain wall part so as to form a trihedron for constituting the corner of a building.

4. A building as in claim 1 wherein at least some of said L-shaped elements are disposed perpendicular to other L-shaped elements when viewed in plan.

5. A building as in claim 1 wherein at least some of said slabs project beyond the facade line and leave underlying modular openings designed to receive door and window frames.

6. A building as in claim 1 wherein the step-shaped edges of at least some of the L-shaped elements incorporate metal angle sections, the abutting faces of which are welded together by access through a free channel space formed by bevelling the upper part of the steps, a suitable casting then being made in said space.

7. A building as in claim 6 wherein said space forms a seat for service piping.

8. A building as in claim 1 wherein some of the L-shaped elements overlie each and wherein between overlying L elements there are provided pins and seats for centering the elements, and rubber bearings.

9. A building as in claim 1 including threaded bosses embedded in the periphery of at least some of the floor portions to receive fixing bolts for auxiliary elements, such as gutters, parapets and the like.

10. A building as in claim 1 including support and bracing elements of U shape cooperating with the L-shaped elements.

11. A building as in claim 1 including support and bracing elements, of L-shape when viewed in plan, cooperating with the L-shaped elements.

12. A building as in claim 10 including U-shaped elements which with an upper slab form lift bays, kitchens, bathrooms and storerooms, and including U-shaped elements without an upper slab forming bays recessed into the building front.

13. A building as in claim 11 wherein plan-disposed L-shaped elements form a stair bay, provided with suitable teeth on which landings rest.

14. A building as in claim 13 wherein the landings rest on the walls of the stair bays and support ramps.

15. A building as in claim 1 wherein a slab, cast simultaneously with an L-shaped element, projects horizontally from the horizontal portion of the respective L-shaped element.

16. A building as a claim 1 wherein at least some of said wall portions are recessed on at least one side.

17. A building as in claim 1 wherein the stepped configuration of the edges is a configuration obtained when two overlying rectangular slabs of approximately the same dimensions are offset with respect to each other both longitudinally and transversely.

* * * * *